US006394226B1

(12) United States Patent
Cavicchioli

(10) Patent No.: US 6,394,226 B1
(45) Date of Patent: May 28, 2002

(54) METHOD FOR MANUFACTURING AN INTAKE MUFFLER PARTICULARLY FOR COMPRESSION CIRCUIT FOR REFRIGERATION SYSTEMS AND THE LIKE

(75) Inventor: Lanfranco Cavicchioli, Vimercate (IT)

(73) Assignee: Clam S.p.A., Ronco Briantino (IT)

( * ) Notice: Subject to any disclaimer, the term of this patent is extended or adjusted under 35 U.S.C. 154(b) by 0 days.

(21) Appl. No.: 09/523,965

(22) Filed: Mar. 13, 2000

(51) Int. Cl.[7] ..... F01N 7/18
(52) U.S. Cl. ..... 181/282; 181/229
(58) Field of Search ..... 181/229, 230, 181/403, 243, 246, 282; 277/370, 371, 374, 375, 376, 399, 402, 407

(56) References Cited

U.S. PATENT DOCUMENTS 4,544,588 A 10/1985 Dieter
4,589,516 A * 5/1986 Inoue et al. ..... 181/282
4,960,368 A 10/1990 Dietmar
5,341,654 A 8/1994 Chip et al.
5,359,159 A * 10/1994 Gommel ..... 181/230
5,424,494 A * 6/1995 Houle et al. ..... 181/229

FOREIGN PATENT DOCUMENTS

| | | |
|---|---|---|
| FR | A-1 005 684 | 4/1952 |
| FR | A-2 690 376 | 10/1993 |
| JP | A-59 043917 | 3/1984 |

* cited by examiner

*Primary Examiner*—Khanh Dang
(74) *Attorney, Agent, or Firm*—Guido Modiano; Albert Josif; Daniel O'Byrne

(57) ABSTRACT

A method for manufacturing intake mufflers, particularly for compression circuits for refrigeration systems and the like, comprising the steps of: molding a cover and a base of an intake muffler; and mutually assembling the base and the cover in a mold inside which a perimetric profile is formed which is adapted to form a retention joint which is molded perimetrically at the edge where the base and the cover are mutually coupled.

3 Claims, 4 Drawing Sheets

METHOD FOR MANUFACTURING AN INTAKE MUFFLER PARTICULARLY FOR COMPRESSION CIRCUIT FOR REFRIGERATION SYSTEMS AND THE LIKE

BACKGROUND OF THE INVENTION

The present invention relates to a method for manufacturing an intake muffler, particularly for compression circuits for refrigeration systems and the like.

Conventionally an air intake device, which acts as silencer and as cooling system, is used for each compressor in compression circuits.

This device, better known as intake muffler, consists of two parts: a base, in which a labyrinth-like path is molded, and a cover; said parts are assembled in order to obtain a hermetic casing.

In view of the particular operating conditions, since the intake is transmitted to capillary ducts, the muffler must be provided so that in addition to ensuring perfect tightness it has no flash which, as a consequence of its separation, might start circulating and obstruct said capillary passages.

Intake mufflers are currently manufactured in two parts which are joined by ultrasonic welding. Although this type of welding occurs in controlled conditions as regards the profile of the two parts to be coupled, the shape of the sonotrode and the frequency and intensity of the welding action, nonetheless some of the welded parts have flash along their inside and outside perimeters.

This is due to the fact that producing a perfect seal and the absence of flash are two mutually contrasting requirements, since a lower welding intensity, and therefore the absence of flash, is matched by a poor seal of the joint provided between the two assembled parts.

On the contrary, higher welding intensity and therefore better tightness of the joint is matched by the presence of internal and external perimetric flash.

It should be observed that internal flash is the most damaging, since it cannot be detected once the muffler has been assembled, and is also responsible for any obstructions of the capillary passages if it breaks off.

Optimization of the ultrasonic welding joint has been sought by designing various shapes of the parts to be assembled and by forming on the perimeter of the cover a rim for containing any flash produced.

These solutions, however, are unsatisfactory, both because the flash persists and because the rim for containing said flash breaks during ultrasonic welding.

Another conventional solution for mutually assembling the cover and the base of the muffler provides for the mutual interlocking of the two parts by means of teeth formed in the plastic; in this manner the muffler is not pressure-tight.

Another conventional solution provides for the insertion, between the base and the cover, of a third element made of rubber-like material which, when compressed, provides at least some sort of pressure-tightness.

SUMMARY OF THE INVENTION

The aim of the present invention is to provide a method for manufacturing an intake muffler for compression circuits for refrigeration systems and the like which combines optimum tightness with substantially complete absence of flash.

Within the scope of this aim, an object of the present invention is to provide a method for manufacturing an intake muffler for compression circuits for refrigeration systems and the like in which internal flash is fully eliminated.

Another object of the present invention is to provide a method for manufacturing an intake muffler for compression circuits for refrigeration systems and the like in which the construction method according to the invention is provided by modifying molds that are currently used.

Another object of the present invention is to provide a method for manufacturing an intake muffler for compression circuits for refrigeration systems and the like which is highly reliable, relatively easy to manufacture and at low costs.

This aim, these objects and others which will become apparent hereinafter are achieved by a method for manufacturing an intake muffler, particularly for compression circuits for refrigeration systems and the like, comprising the steps of:

molding a cover and a base of an intake muffler; and mutually assembling said base and said cover in a mold inside which a perimetric profile is formed, being adapted to form a retention joint which is molded perimetrically at the edge where said base and said cover are mutually coupled.

This aim, these objects and others are also achieved by an intake muffler for compression circuits, particularly for refrigeration systems and the like, comprising a base provided with air passage channels and with a cover which is meant to be coupled to said base, characterized in that it comprises a retention joint which is molded around the perimetric seam between said base and said cover.

BRIEF DESCRIPTION OF THE DRAWINGS

Further characteristics and advantages of the invention will become apparent from the following detailed description of a preferred but not exclusive embodiment of the device according to the invention, illustrated only by way of non-limitative example in the accompanying drawings, wherein.

DESCRIPTION OF THE PREFERRED EMBODIMENTS

Figure 2:
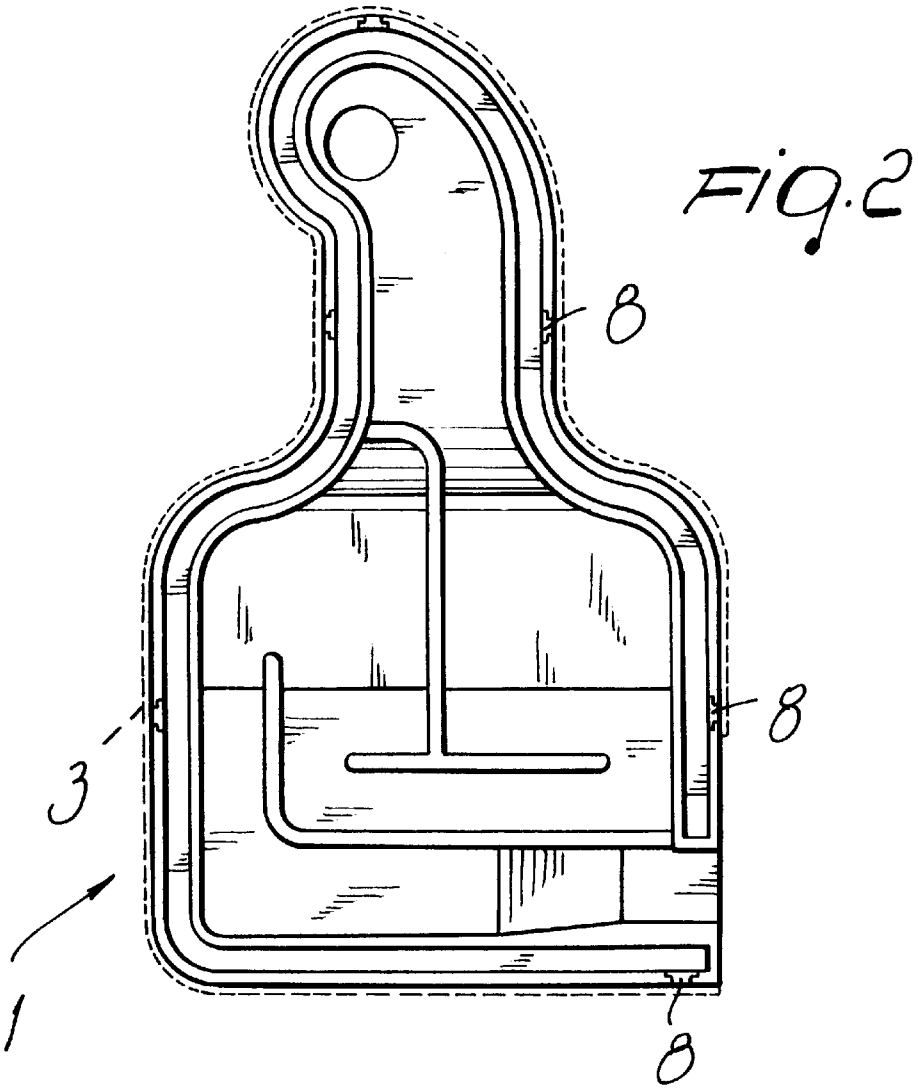
FIG. 2 is a plan view of the base of the intake muffler, produced with the method according to the present invention.
Figure 1:
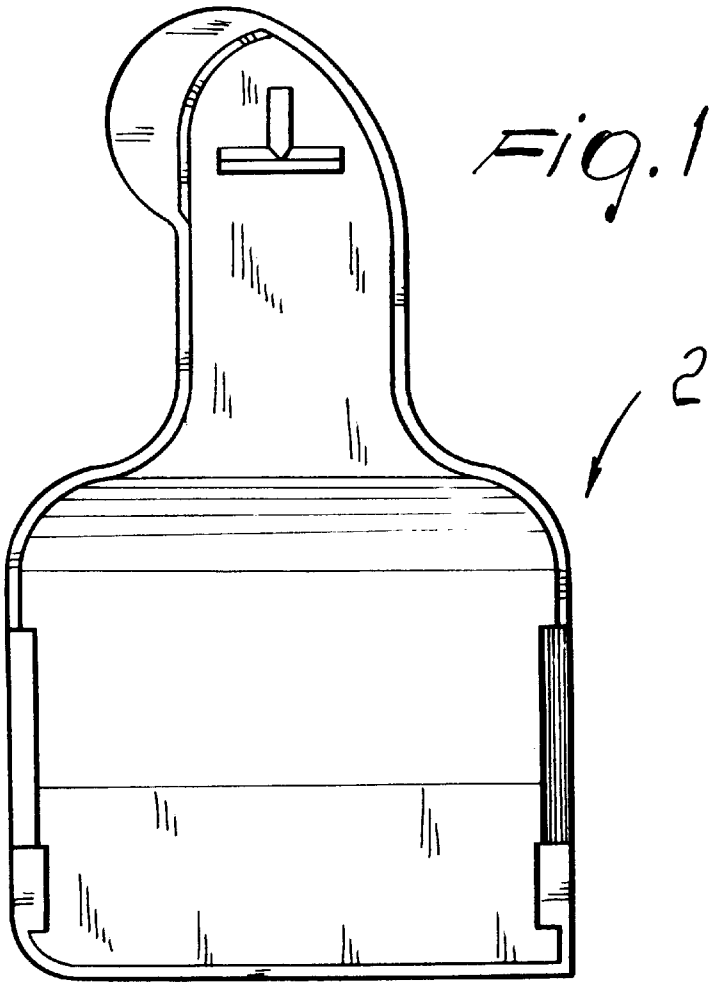
FIG. 1 is a plan view of the cover of the intake muffler, produced with the method according to the present invention.
Figure 3:
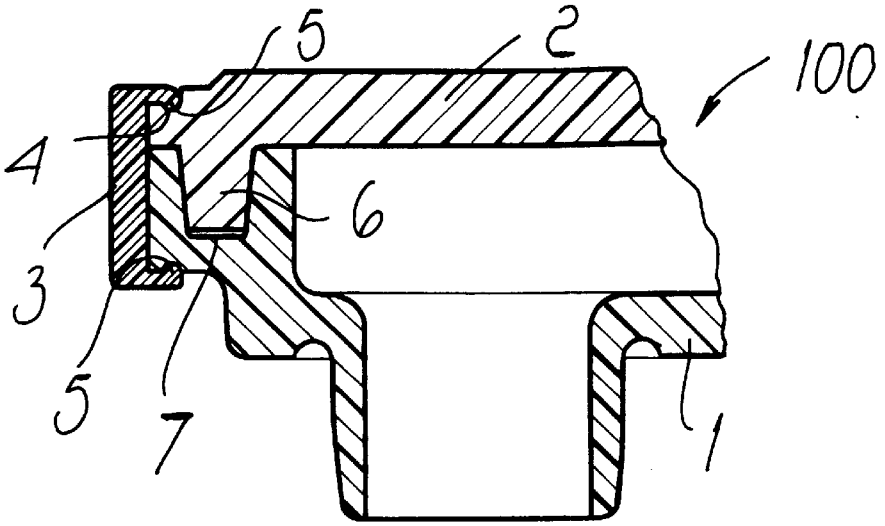
FIG. 3 is a partial sectional side elevation view of a detail of the connection between the base and the cover of the intake muffler provided by means of the method according to the present invention.
Figure 4:
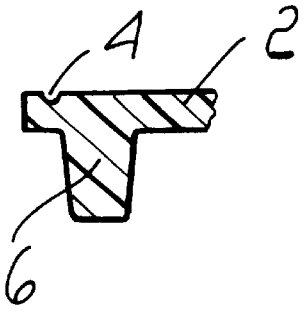
FIG. 4 is a partial sectional side elevation view of the interlocking portion of the cover of the intake muffler produced according to the present invention.
Figure 5:
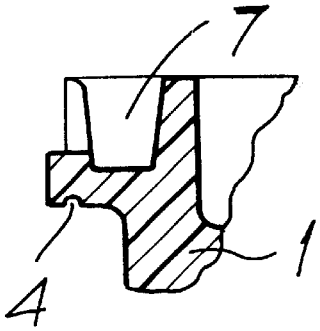
FIG. 5 is a partial sectional side elevation view of the interlocking portion of the base of the intake muffler produced according to the invention.
Figure 6:
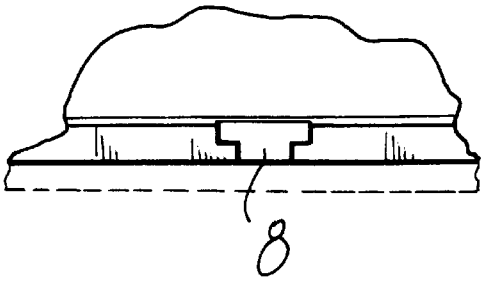
FIG. 6 is a view of a detail of the base of the muffler for the hermetic mutual assembly of the base and of the cover of the intake muffler.

With reference to the above figures, the method for manufacturing the intake muffler according to the present invention comprises a first step which consists in molding the base 1 and the cover 2 of the muffler in separate molds, thus obtaining the finished parts meant to be assembled in order to constitute the intake muffler, generally designated by the reference numeral 100 in FIG. 3.

The step for the assembly of the muffler is performed in a suitable assembly mold, in which a perimetric profile is formed, being adapted to provide a retention joint 3 which is molded perimetrically at the coupling edge of the base 1 and of the cover 2.

The retention joint 3 thus closes the perimeter of the base and of the cover of the muffler; in order to provide a hermetic coupling on the upper surface of the cover 2, at the edge, and on the lower surface of the base, at the rim, perimetric grooves 4 are provided in which complementarily shaped raised portions 5 engage. The raised portions are formed on the retention joint 3 as a consequence of molding in the mold for the assembly of the muffler 100.

The retention joint therefore has, in a transverse sectional view, a substantially C-shaped profile as shown in FIG. 3.

The coupling between the base 1 and the cover 2 occurs by means of the interlocking of a frustum-shaped protrusion 6 of the cover 2 in a cavity 7 formed in the base 1.

The frustum-like shape of the cavity 7 and of the protrusion 6 allows to obtain an interlock between the base 1 and the cover 2 which combines with the action of the retention joint 3, engaging between the rim of the cover 2 and the rim of the base 1, as described above.

The molding of the retention joint 3 around the seam for coupling the base and the cover eliminates the possibility of forming internal flash and any external flash that might form at the closure regions of the mold can be easily eliminated.

The compactness of the muffler can be increased by using additional systems for mutually anchoring the retention joint 3 and the base 1 of the muffler.

In particular, it is possible to provide undercuts 8 formed as grooves provided in the outer rim of the base 1 of the muffler.

By means of said undercuts 8, the engagement of the retention joint 3 on the rim of the assembled muffler is stronger.

In practice it has been observed that the method according to the invention fully achieves the intended aim, since it allows to perform the hermetic assembly of an intake muffler while avoiding the forming of internal and external perimetric flash, which can be damaging, if it breaks off, by obstructing capillary passages in which the cooling air aspirated by the compressor through said muffler must pass.

Figure 7:
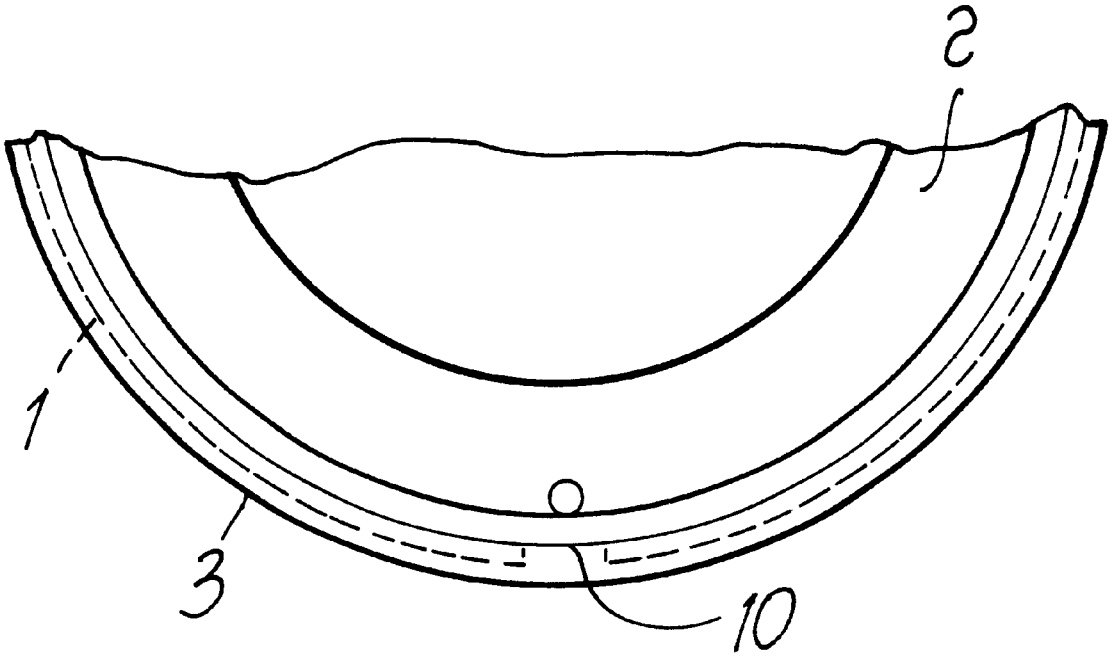
FIG. 7 is a partial plan view of the intake muffler according to a second embodiment of the present invention.

The method thus conceived is susceptible of numerous modifications and variations, all of which are within the scope of the inventive concept; all the details may furthermore be replaced with other technically equivalent elements. For example, as shown in FIG. 7, the base 1 and the cover 2 of the muffler can be provided, at one or more outer rim regions, with an undercut which is more definite than the undercuts 4 (perimetric grooves) shown in FIG. 3, to anchor the retention joint 3. The outer rim profile is suitably interrupted at one or more regions, to define at least one indentation 10. Accordingly, the retention joint 3 is molded perimetrically and the indentation 10 fills with molded material when the base and the cover are assembled, in order to strengthen the coupling.

Figure 8:
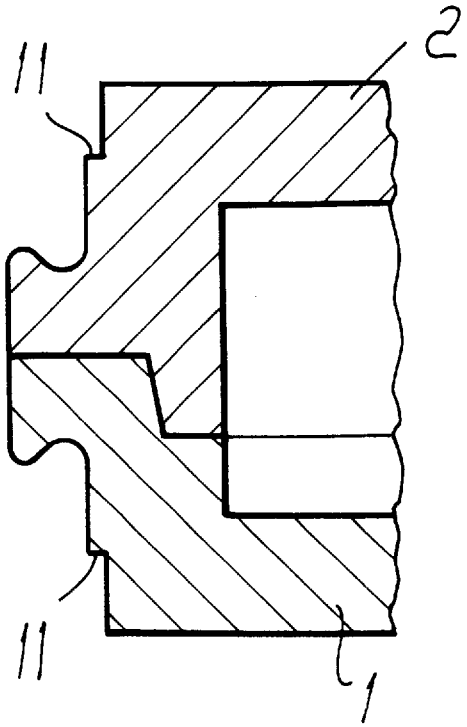
FIG. 8 is a sectional view of a detail of a further embodiment of the intake muffler according to the present invention.

With regard to FIG. 8, the outer edge of both the cover 2 and the base 1, whereon the retention joint is molded, is shaped so as to define respective projecting steps which allow to eliminate flashes which can be generated due to the molding pressure when the retention joint 3 is molded perimetrically at the coupling edge of the base 1 and of the cover 2.

Figure 9:
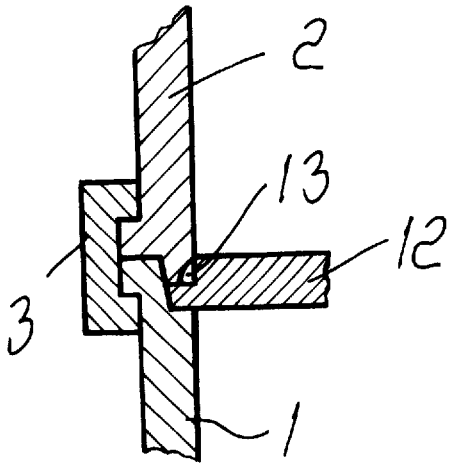
FIG. 9 is a sectional view of a detail of a still further embodiment of the intake muffler according to the present invention.

FIG. 9 illustrates a further embodiment of the intake muffler of the present invention in which inner inserts 11 can be connected to the base 1 and cover 2 by means of restrained joints 13.

In practice, the materials employed, so long as they are compatible with the specific use, as well as the dimensions, may be any according to requirements and to the state of the art.

What is claimed is:

1. An intake muffler for compression circuits, particularly for refrigeration systems and the like, comprising a base provided with air passage channels and a cover meant to be coupled to said base, further comprising a retention joint, have a substantially C-shaped cross-section, which is molded around a perimetric seam between said base and said cover, the upper surface of said cover and the lower surface of said base respectively having, at an edge thereof, a groove, said retention joint is molded so that it is anchored to said base and said cover, said retention joint being molded so as to be engaged in said grooves formed in the base and in the cover, said base being provided with a frustum-shaped cavity and said cover being provided with a complementarily shaped protrusion adapted to engage with said cavity, to interlock said cover with said base.

2. The intake muffler according to claim 1, wherein said base and cover each have an indentation defined in said perimetric groove.

3. The intake muffler according to claim 1, wherein said retention joint has ends shaped so as to form inwardly facing protrusions adapted to engage said grooves of said cover and said base.

* * * * *